United States Patent [19]

Hadary

[11] 4,370,773

[45] Feb. 1, 1983

[54] TOOTHBRUSH

[76] Inventor: Joseph Hadary, 5405 Linden Ct., Bethesda, Md. 20014

[21] Appl. No.: 167,362

[22] Filed: Jul. 10, 1980

[51] Int. Cl.[3] ..... A46B 9/10

[52] U.S. Cl. ..... 15/172; 15/176; 403/328

[58] Field of Search ..... 15/172, 176, 184, 185, 15/143 R, 144 B, 144 A, 167 R; 81/1 N; 403/328, 325, 327

[56] References Cited

U.S. PATENT DOCUMENTS

| | | | |
|---|---|---|---|
| 2,221,371 | 11/1940 | Bethune | ,03/328 |
| 3,886,618 | 6/1975 | Paoletti | 15/172 |
| 3,994,039 | 11/1976 | Hadary | 15/172 |
| 4,033,007 | 7/1977 | Hadary | 15/172 |
| 4,106,152 | 8/1978 | Hadary | 15/172 |

FOREIGN PATENT DOCUMENTS

| | | | |
|---|---|---|---|
| 14116 | of 1900 | United Kingdom | 15/172 |

*Primary Examiner*—Peter Feldman
*Attorney, Agent, or Firm*—Dennis H. Lambert

[57] ABSTRACT

A toothbrush having a bristle supporting head pivotally mounted to a handle for pivotal movement of the head and bristles about a pivot axis substantially perpendicular to the axis of the handle to a plurality of positions to gain easy access to tooth surfaces at opposite sides of the mouth, the bristles extending in a direction mutually perpendicular to the axis of the handle and pivot axis, and the handle having an enlarged hollow end for storage therein of a bristle supporting head or the like and for supporting the toothbrush in an upright, free standing position. A spring biased detent is engaged with the pivot shaft of the bristle supporting head to retain it assembled to the handle and to maintain it in a predetermined adjusted pivoted position. An actuator projects beyond the end of the handle for engagement with the finger to release the bristle supporting head.

8 Claims, 9 Drawing Figures

TOOTHBRUSH

BACKGROUND OF THE INVENTION

This invention is an improvement over earlier U.S. Pat. Nos. 3,994,039, 4,033,007 and 4,106,152.

This invention relates to dental equipment for promoting oral hygiene and, in particular, relates to a unique and improved toothbrush for effecting more thorough cleansing of teeth and gum areas near the base of the teeth. With prior art toothbrushes it is very difficult to effectively clean the gingival margins and sulcus areas, particularly in difficult to reach portions of the mouth, because of the fixed relationship of the bristles to the handle, and also due to the large size of the bristles and handle. Further, the construction of prior art toothbrushes makes it necessary to tilt the handle both horizontally and vertically in order to reach certain areas of the teeth.

The importance of cleaning not only the tooth surfaces, but also of cleaning the gingival crevice and of massaging the gums is clearly evident when it is recognized that diseases of the gums, such as gingivities, for example, afflict approximately 65% of the nation's school children, and in adults, at the age of 40 for example, nearly 100% have some form of tooth or gum disease. If the teeth were properly cleaned, the bacteria which cuase tooth and gum diseases could be significantly reduced, if not eliminated, and the incidence of disease reduced accordingly.

Toothbrushing is considered the most reliable means of cleaning teeth. However, for most persons, even well-performed brushing may be insufficient to maintain proper control of plaque. Therefore, additional technics and materials (toothpicks, dental floss, interspace brushes, etc.) should be introduced according to the individual's need.

It is clear that a universal mechanical cleansing procedure, which is adequate for everyone, has not yet been developed. There are certain general principles that may be applicable in most cases, but just as no two dentitions are dentical, no one method of cleansing is adequate for every dentition. Therefore, a specific oral hygiene program must be designed for each individual.

In this connection, there are many widely recognized and proven methods of using a toothbrush, featuring either a roll method or scrubbing technique. Whichever method used, it is desirable to thoroughly clean the interproximal areas of the teeth, as well as the buccal and lingual surfaces, and the sulcus areas at the base of the teeth. However, due to the natural arc of the teeth, and the fact that the teeth have both concave and convex surfaces and the teeth are of different sizes, on both upper and lower jaws, and teeth are frequently malposed, all tooth surfaces are usually not effectively cleaned.

Many attempts have been made in the prior art to devise a toothbrush capable of performing satisfactorily all of the above functions. However, most efforts in this regard have been directed toward different bristle configurations, whereby the bristles are constructed such that they more readily enter the interproximal areas or the gingival margins at the base of the teeth. However, even with such prior art constructions, it is very difficult to reach the lingual surfaces of the lower anterior teeth, and the buccal surfaces of the posterior teeth, as well as the gingival crevice of the posterior teeth. For example, when attempting to brush the lingual surfaces of the lower anterior teeth, it is necessary with prior art tootbrush constructions to elevate the handle of the toothbrush in order that access of the bristles to the lingual surfaces of the anterior teeth can be gained. This, of course, is awkward for anyone to do, and is particularly difficult for persons suffering from arthritis or other ailments which renders it difficult for them to elevate their arms above certain positions, and it is also difficult for children to manipulate the handle in a proper manner to gain proper access to the various surfaces of the teeth. Consequently, such persons including small children, frequently do not brush the difficult to reach surfaces of the teeth, and the incidence of disease is thereby increased.

The toothbrushes according to the present invention, as well as the earlier patents mentioned above, are relatively small in comparison with conventional prior art toothbrushes, and may be easily carried in the pocket or the like for use away from home. Further, the base of the handles of these toothbrushes enables them to be free standing, thus avoiding the hygienic problems encountered due to laying a conventional toothbrush on an unclean surface, or supporting it from a holder or the like.

Additionally, the bristle head of this as well as the earlier toothbrushes is small in size, thus making it easier to use to reach relatively inaccessible areas of the mouth. Further, with the toothbrush of the invention, the small, replaceable bristle head can easily be replaced, and it is not necessary to replace the whole toothbrush, as with prior art toothbrushes.

However, with the toothbrushes of the prior art, difficulty is sometimes encountered in either affixing the bristle head to the handle, or releasing it therefrom. Moreover, the prior art toothbrushes are reatively complex in construction and present areas of collection of debris and bacteria.

SUMMARY OF THE INVENTION

Accordingly, it is an object of this invention to provide a toothbrush having a unique construction which provides for easy access of the bristles to all of the surface areas of the teeth in a person's mouth, and which has a simple and economical construction and is easy to use.

Another object of the invention is to provide a toothbrush having a pivotal head carried by the handle thereof, such that the head may be pivoted to a plurality of positions, and in said positions, access to the lingual surfaces of the teeth on oppsite sides, respectively, of the mouth is greatly enhance, and wherein the handle is small and is configured whereby it may be readily grasped and manipulated with the fingers, and the actuating means for disengaging the head from the handle is easily manipulated.

A further object of the invention is to provide a toothbrush having a removable head and bristles thereon, whereby heads having different bristle configurations can be quickly and easily attached to the handle for providing the best bristle configuration for particular cleaning operations to be performed on the teeth and gums, such as, for example, small bristle heads for reaching confined areas in the mouth, and wherein a removable cap is provided on a hollow handle portion for storage of implements, the removable cap being sized to closely confine a bristle head so as to prevent its loss when the cap is removed, while at the same time maintaining the shape of the bristles by snug engagement therewith.

Another object of the invention is to provide a device for cleaning teeth which includes interchangeable implements such as brushes, picks, flossing devices and the like.

BRIEF DESCRIPTION OF THE DRAWINGS

Various other objects, features and attendant advantages of the present invention will be more fully appreciated as the same becomes better understood from the following detailed description when considered in connection with the accompanying drawings wherein like reference characters designate like or corresponding parts throughout the several views, and wherein.

DETAILED DESCRIPTION OF THE PREFERRED EMBODIMENTS

Figure 1:
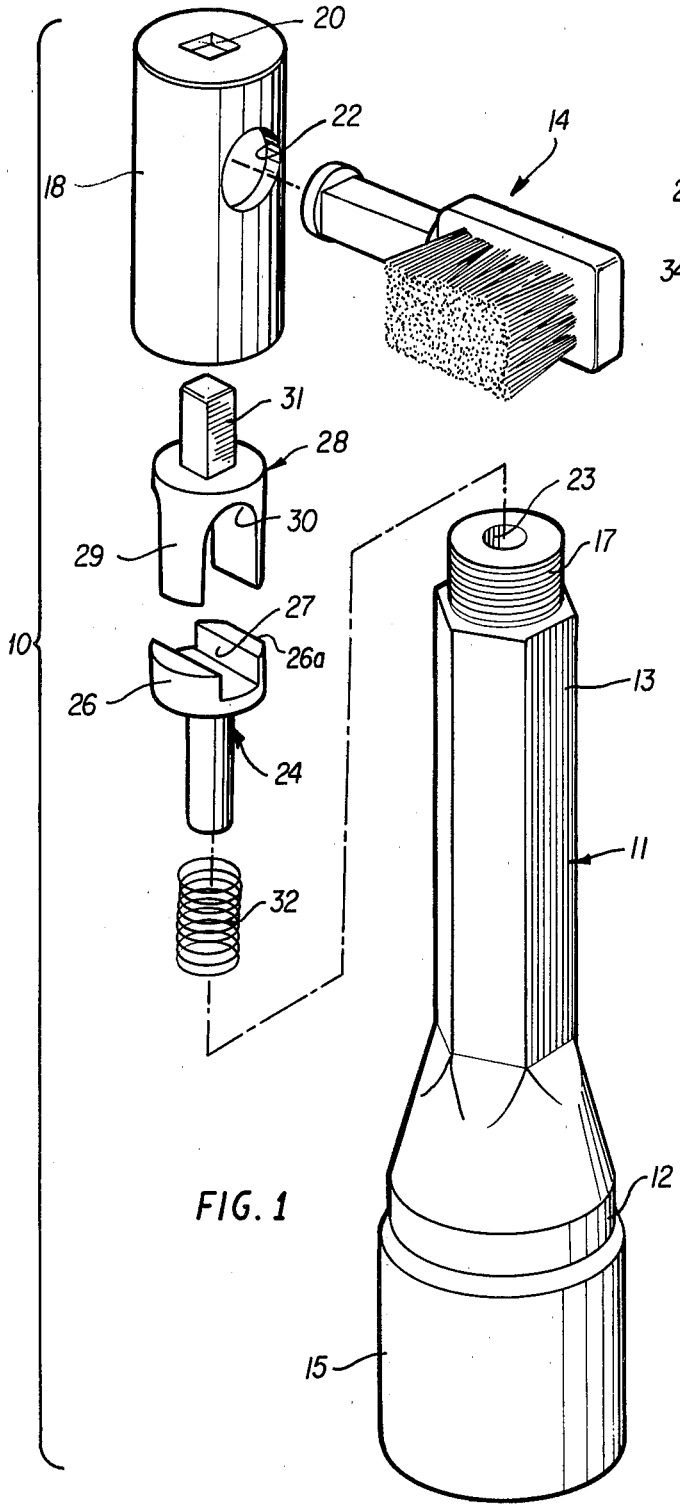
FIG. 1 is an exploded perspective view of the preferred form of toothbrush according to the invention.
Figure 3:
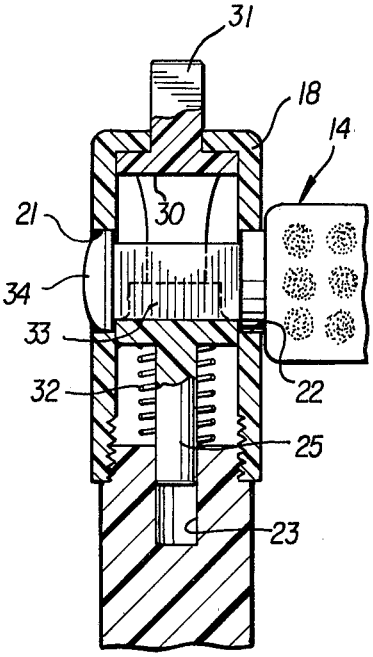
FIG. 3 is an enlarged, fragmentary, sectional view taken along line 3—3 in FIG. 2.

In the drawings, wherein like reference numerals indicate like parts throughout the several views, a first form of brush in accrodance with the invention is indicated generally at 10, and comprises an upright, self-supporting handle 11 having an enlarged, hollow base end 12, and an elongate, forward end 13 formed integrally with the base end 12. A bristle head configuration 14 is releasably connected to the upper or distal end of the forward end portion 13 of the handle 11.

The forward end 13 of the handle is hexagonal in cross-sectional configuration to facilitate gripping thereof, and a removabl end cap 15 is suitably removably secured to the lower open end of base portion 12, defining an enclosed, hollow storage chamber or compartment 16 (See FIG. 2) in the base portion in which various items may be stored, as, for example, a bristle head 14 or pick implement or the like.

The upper end of the handle portion 13 is externally threaded at 17, and an elongate tubular member 18 extends coaxially from the upper end of the handle portion 13 and has an internally threaded lower end 19 threadably engaged with the threaded portion 17 of the upper end of handle portion 13, for supporting the cylindrical member 18 thereon. The upper end of the cylindrical member has an opening 20 formed through the center thereof, and a pair of aligned openings 21 and 22 are formed in diametrically opposite sides thereof. The opening 20 is polygonally shaped for a purpose to be described.

The upper end of the handle portion 13 also has cylindrically shaped blind bore 23 therein, for cooperation with a bristle head retainer 24. The bristle head retainer 24 has a depending guide shaft 25 which has a cross sectional size and shape complemental to that of blind bore 23, and the shaft 25 is slidably received in the bore 23 for guiding movement of the retainer 24. The depth of bore 23 and length of shaft 25 are such that retainer 24 has a limited downward movement. The upper end of retainer 24 is diametrically enlarged at 26 and has a transversely extending channel 27 formed in the end thereof. The enlarged end portion 26 is closely slidably received in the cylindrical member 18, and the channel 27 is aligned with the openings 21 and 22 in member 18.

An actuator 28 is positioned above retainer 24 within cylindrical member 18, and has a bifurcated lower end 29 defining a downwardly facing arch-shaped opening facing the channel 27. A polygonally shaped pin 31 projects upwardly from actuator 28 and extends through opening 20 in member 18 for engagement with the finger to depress the actuator.

Figure 2:
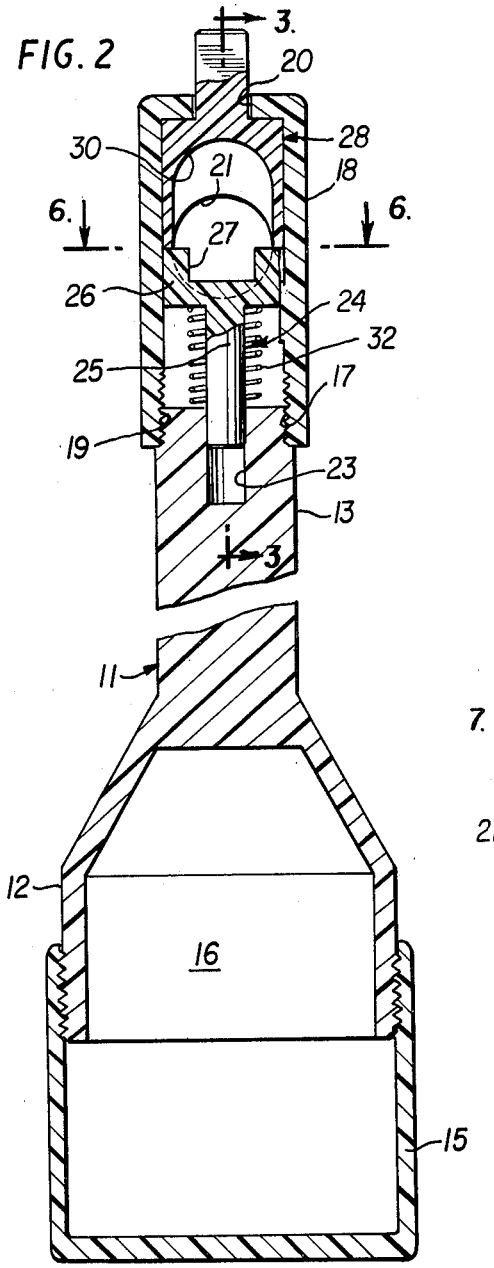
FIG. 2 is a vertical sectional view of the toothbrush in FIG. 1, with a portion thereof broken away.
Figure 4:
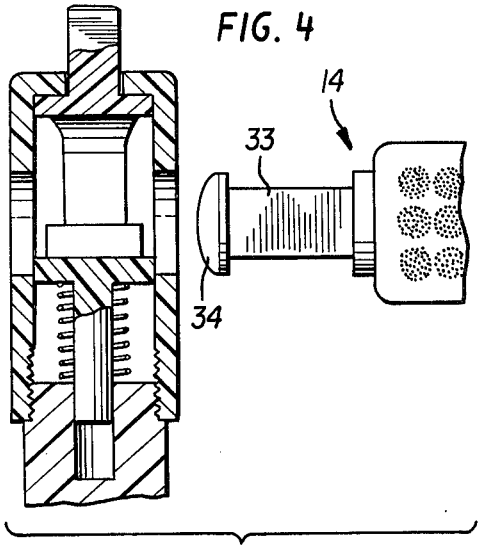
FIG. 4 is an enlarged, fragementary, sectional view similar to FIG. 3, with the bristle head removed from the handle.
Figure 5:
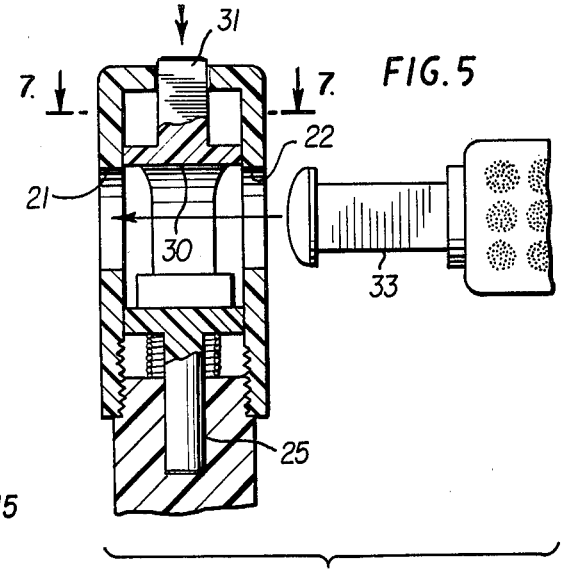
FIG. 5 is a view similar to FIG. 4, showing the actuator depressed for applying the bristle head to the handle.
Figure 6:
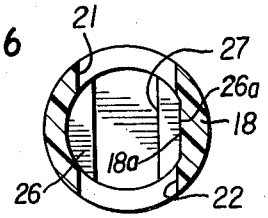
FIG. 6 is a view in section taken along line 6—6 in FIG. 2.
Figure 7:
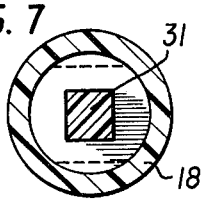
FIG. 7 is a view section taken along line 7—7 in FIG. 5.

A spring 32 is disposed between retainer 24 and the upper end of handle portion 13, normally urging the retainer and actuator upwardly as seen in FIG. 2. In this position, the channel 27 engages a shaft 33 of the bristle head 14 to prevent rotation of the shaft and bristle head, and an enlarged head 34 on the end of shaft 33 engages the retainer to prevent withdrawal of shaft 33 from the openings 21 and 22 and thus from the handle.

By depressing the pin 31 and thus the actuator 28 and retainer 24, the retainer at channel 27 is disengaged from shaft 33 and the side of the retainer is disengaged from head 34, thereby releasing the bristle head so that it may be rotated to a new position or removed from the handle. It should be noted that arch-shaped opening 30 is larger than head 34 to permit its withdrawal. Further, the depth of blind bore 23 and length of shaft 25 are such that downward movement of the retainer and actuator is stopped before the upper end of arch-shaped opening 30 will interfere with shaft 33 or head 34.

Cooperating flat surfaces 18*a* and 26*a* are on the inner surface of member 18 and outer surface of 26, to prevent relative rotation therebetween and maintain alignment of channel 27 and openings 21 and 22.

Figure 8:
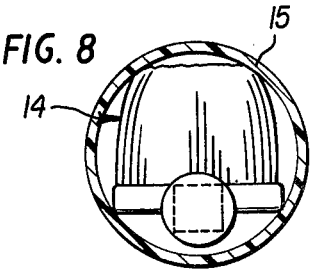
FIG. 8 is an enlarged sectional view of the cap, showing a bristle head confined therein.

In FIG. 8, the manner in which a bristle head 14 is confined in the cap 15 can be seen. The bristles are engaged by the inner surface of the cap to prevent them from spreading and also to retain the bristle head in the cap.

Figure 9:
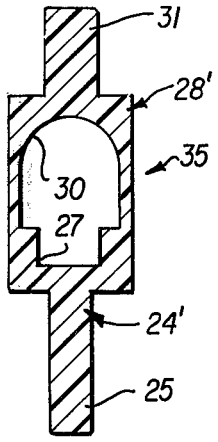
FIG. 9 is an enlarged sectional view of a modified, one-piece actuator and bristle head retainer.

A modification is indicated in FIG. 9, wherein the retainer 24' and actuator 28' are integrally formed in one piece 35.

The various components of the brush may be made of plastic or metal or other suitable material, as desired, and the cap may be press-fitted into place or retained with a snap detent rather than the threaded engagement shown in the drawings.

The toothbrush of the present invention may be completely disassembled for cleaning, repair or replacement of various parts, without requiring the use of any special tools or the like.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A toothbrush comprising:

an elongate handle means having opposite end portions, one of said end portions comprising a hollow, diametrically enlarged base capable of supporting the toothbrush in an upright position and of a size to receive and store a bristle head therein;

the other end of the handle means comprising an elongate, reduced diameter shaft having an axial bore in the end thereof;

a tubular member fixed to the end of said shaft and having a pair of diametrically aligned openings in the side thereof;

a bristle head adjustably carried by the handle means at said other end thereof and including a bristle head shaft projecting therefrom, said bristle head shaft extending at approximately a right angle to the axis of the handle means and releasably adjustably engaged with the handle means to support the bristle head in adjusted positions on the handle means, and bristles on the bristle head extending in a direction mutually perpendicular to the axis of the handle means and the axis of the bristle head shaft;

said bristle head shaft extending through the aligned openings in the tubular member having a polygonal cross sectional configuration; and bristle head retaining means carried in the tubular member for selective engagement with the bristle head shaft to prevent it from rotating and to retain it on the handle means, said retaining means having a channel shaped and sized complementally to the bristle head shaft and being actuatable through the end of the handle means for releasing the bristle head.

2. A toothbrush as in claim 1, wherein the channel in the retaining means closely engages the side of the bristle head shaft to prevent rotation of the bristle head shaft; and the bristle head shaft has an enlarged head on one end thereof which engages against the side of the retaining means at one end of the channel to prevent withdrawal of the bristle head from the handle means.

3. A toothbrush as in claim 2, wherein the retaining means has a guide shaft thereon received in the axial bore in the end of the elongate handle means shaft for guiding movement of the retaining means during use.

4. A toothbrush as in claim 3, wherein spring means is engaged between the retaining means and the elongate handle means shaft for normally urging the retaining means into engagement with the bristle head shaft to retain the bristle head in position.

5. A toothbrush as in claim 4, wherein a separate actuator for the retaining means is disposed in the tubular member outwardly of the retaining means relative to the handle means;

the tubular means has an axial opening in the end thereof;

and the actuator means has an actuating pin thereon extended through the axial opening in the tubular member for engagement with the finger to depress the actuator means and retaining means against the spring means to release the bristle head.

6. A toothbrush as in claim 1, wherein a removable cap is releasably secured on the diametrically enlarged base of the handle means; and said cap has internal dimensions such as to closely receive and confine a bristle head disposed therein for retaining the bristle head to prevent its accidental displacement from the cap and to maintain the shape of the bristles.

7. A toothbrush as in claim 5, wherein the shaft on the retaining means and the axial bore in the end of the handle means shaft are sized such as to limit movement of the actuator means and retaining means toward the handle means so that the actuator means and retaining means cannot be depressed beyond a position for free release of the bristle head.

8. A toothbrush as in claim 1, wherein a one-piece actuator means and retaining means are disposed in the tubular member for selective operation to retain the bristle head in position or release the bristle head when desired.

* * * * *